US010801771B2

(12) United States Patent
Troutman

(10) Patent No.: US 10,801,771 B2
(45) Date of Patent: Oct. 13, 2020

(54) CONDENSER FAN MOTOR MOUNTS AND GUARDS

(71) Applicant: Heatcraft Refrigeration Products LLC, Richardson, TX (US)

(72) Inventor: Albert Stephen Troutman, Conyers, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 149 days.

(21) Appl. No.: 15/979,450

(22) Filed: May 14, 2018

(65) Prior Publication Data

US 2019/0346195 A1 Nov. 14, 2019

(51) Int. Cl.

| | |
|---|---|
| ***F25D 23/00*** | (2006.01) |
| ***F04D 29/64*** | (2006.01) |
| ***F04D 25/06*** | (2006.01) |
| ***F04D 29/54*** | (2006.01) |

(52) U.S. Cl.

CPC ..... *F25D 23/006* (2013.01); *F04D 25/0613* (2013.01); *F04D 29/541* (2013.01); *F04D 29/646* (2013.01); *F25D 2323/00284* (2013.01)

(58) Field of Classification Search

CPC ..... F25D 23/006; F25D 2323/00284; F04D 29/646; F04D 29/541; F04D 25/0613; F04D 29/703

USPC ..... 417/423.15; 62/507; 416/244 R

See application file for complete search history.

(56) References Cited

U.S. PATENT DOCUMENTS

| | | | | | |
|---|---|---|---|---|---|
| 1,746,531 | A * | 2/1930 | Hubbell, Jr. | F04D 29/703 | 417/369 |
| 2,258,325 | A * | 10/1941 | Hess | F04D 29/703 | 417/359 |
| 2,478,829 | A * | 8/1949 | Lechtenberg | H02K 5/00 | 416/244 R |
| 2,512,159 | A * | 6/1950 | Koch | F04D 29/646 | 310/91 |
| 2,656,974 | A * | 10/1953 | Holstein | F04D 29/703 | 416/244 R |
| 2,945,359 | A * | 7/1960 | Macleod | F24F 1/02 | 62/280 |
| 3,152,455 | A * | 10/1964 | Ware | F25B 49/027 | 62/184 |
| 3,584,469 | A * | 6/1971 | Butts | F25D 17/065 | 62/295 |

(Continued)

*Primary Examiner* — Paul Alvare
*Assistant Examiner* — Kirstin U Oswald
(74) *Attorney, Agent, or Firm* — Hubbard Johnston, PLLC

(57) ABSTRACT

In an embodiment, a fan mounting assembly for use in refrigeration system includes a mounting body having a first side and a second side with a fan opening. The mounting body includes a collar extending from the second side of the mounting body around the fan opening, a flange extending outboard of the collar, and a plurality of retainers extending from the second side of the mounting body outward from the fan opening. Each retainer has a fastener opening extending therethrough. The fan mounting assembly further includes a motor mount and guard that includes a plurality of rings and a plurality of legs extending radially from a center portion. Each leg has a proximal end with a proximal eyelet formed thereon and a distal end with a distal eyelet formed thereon. The distal eyelet is configured to align with the fastener opening of a corresponding retainer.

20 Claims, 9 Drawing Sheets

(56) References Cited

U.S. PATENT DOCUMENTS

| | | | | | |
|---|---|---|---|---|---|
| 3,926,537 | A * | 12/1975 | Piper | F04D 29/626 | 417/353 |
| 4,441,851 | A * | 4/1984 | Starkweather | B60P 3/125 | 212/180 |
| 4,457,672 | A * | 7/1984 | Ogura | F04D 25/10 | 248/27.1 |
| 4,522,160 | A * | 6/1985 | Speers | F04D 29/646 | 123/41.49 |
| 4,710,096 | A * | 12/1987 | Erlam | F04D 29/526 | 411/338 |
| 8,672,615 | B2 * | 3/2014 | Ruckert | F04D 25/0613 | 415/121.2 |
| 2005/0051309 | A1 * | 3/2005 | Mori | F04D 29/582 | 165/121 |
| 2007/0058342 | A1 * | 3/2007 | Wu | H05K 7/20154 | 361/695 |
| 2009/0169387 | A1 * | 7/2009 | Yoo | F04D 29/668 | 416/190 |
| 2009/0211287 | A1 * | 8/2009 | Steele | F25D 19/003 | 62/259.1 |

* cited by examiner

CONDENSER FAN MOTOR MOUNTS AND GUARDS

TECHNICAL FIELD

This disclosure is directed, in general, to refrigeration systems, and more specifically, to condenser fan motor mounts and guards, systems, and methods.

BACKGROUND

Air conditioning and refrigeration systems provide cooling, ventilation and humidity control for all or part of a climate-controlled area such as a refrigerator, a cooler, a building and the like. Generally, a refrigeration cycle includes four basic stages to provide cooling. First, a vapor refrigerant is compressed at high pressure and high temperature using one or more compressors. Second, the compressed vapor refrigerant is cooled into a liquid using condensers. The condensers may utilize a fan to move ambient air across condenser coils to provide a heat exchange. Third, the liquid refrigerant is passed through an expansion device that reduces the pressure and further reduces the temperature of the liquid refrigerant. The liquid refrigerant is then pumped within the climate-controlled area to one or more evaporators. The liquid refrigerant absorbs heat from the surroundings in an evaporator coil, causing the liquid refrigerant to evaporate back into a vapor. Finally, the vapor refrigerant returns to the compressor and the cycle repeats. Various alternatives on this basic refrigeration cycle are known and may be used herein.

The evaporator, in a typical refrigeration system, is positioned inside the climate-controlled area to transfer heat from the climate-controlled area to the refrigerant. The remaining components are typically positioned outside the climate-controlled area and may be positioned within a condenser unit housing. The condenser unit housing may include one or more compressors, a condenser coil, and a fan assembly. The condenser dispenses the heat from the climate-controlled area to the ambient surroundings or elsewhere.

SUMMARY

According to an illustrative embodiment, a refrigeration system for cooling a climate-controlled area includes a closed refrigeration circuit. The closed refrigeration circuit includes a plurality of fluidly coupled conduits, an expansion device fluidly coupled to the plurality of conduits, an evaporator fluidly coupled to the plurality of conduits, a compressor fluidly coupled to the plurality of conduits, and a condenser unit fluidly coupled to the plurality of conduits, wherein the condenser unit has a condenser fan panel assembly with a ventilation opening and a fan mounting assembly coupled to the condenser fan panel assembly. The fan mounting assembly includes a mounting body having a first side and a second side with a fan opening formed therethrough. The mounting body includes a lip member formed on the second side of the mounting body and positioned around the fan opening, a plurality of flange members extending outboard of the lip member, and a plurality of retaining gusset members comprising a gusset channel. The gusset channel extends radially outward from the fan opening and is formed with at least one fastener opening perpendicular to the gusset channel. The fan mounting assembly further includes a motor mount and guard, a fan motor, and a plurality of fan blades. The motor mount and guard includes a plurality of concentric rings and a plurality of legs extending radially at least partially from a center portion, wherein each leg of the plurality of legs has a proximal end and a distal end, and the distal end is formed with a distal eyelet for receiving a fastener and wherein the distal eyelet is configured to align with the at least one fastener opening of a corresponding gusset channel. The fan motor is coupled to the motor mount and guard proximate the center portion, and the plurality of fan blades are coupled to the fan motor.

According to an illustrative embodiment, a fan mounting assembly for use in refrigeration system includes a mounting body having a first side and a second side with a fan opening formed therein. The mounting body includes a collar extending from the second side of the mounting body and positioned around the fan opening, a plurality of flange members extending outboard of the collar, and a plurality of retaining gusset members extending from the second side of the mounting body outward from the fan opening. Each of the plurality of retaining gusset members have a fastener opening extending therethrough. The fan mounting assembly further includes a motor mount and guard that includes a plurality of rings and a plurality of legs extending radially at least partially from a center portion, wherein each leg has a proximal end with a proximal eyelet formed thereon and a distal end with a distal eyelet formed thereon, wherein the distal eyelet is configured to align with the fastener opening of a corresponding retaining gusset member.

According to an illustrative embodiment, a fan mounting assembly for use in a refrigeration system includes a mounting body having a first side and a second side with a fan opening formed therein, a collar extending from the second side of the mounting body around the fan opening, and a plurality of retaining gusset members comprising a gusset channel. The gusset channel extends radially outward from the fan opening and is formed with at least one fastener opening perpendicular to the gusset channel. The fan mounting assembly further includes a motor mount and guard comprising a plurality of rings and a plurality of legs extending radially from a center portion, wherein each leg has a proximal end with a proximal eyelet and a distal end with a distal eyelet, wherein the distal eyelet is configured to align with the fastener opening of a corresponding gusset channel.

Other embodiments are included below and contemplated herein.

DESCRIPTION OF THE DRAWINGS

Illustrative embodiments of the present disclosure are described in detail below with reference to the attached drawing figures, which are incorporated by reference herein and wherein.

DETAILED DESCRIPTION

A condenser unit housing of a refrigeration system typically houses a number of different elements. And because it is often desirable to minimize the size of the condenser unit housing, the spacing between elements housed therein may leave little room for technicians to access the elements for service or replacement. Thus, element designs that make it easier for maintenance personal to access or remove the elements, may be beneficial.

Figure 1:
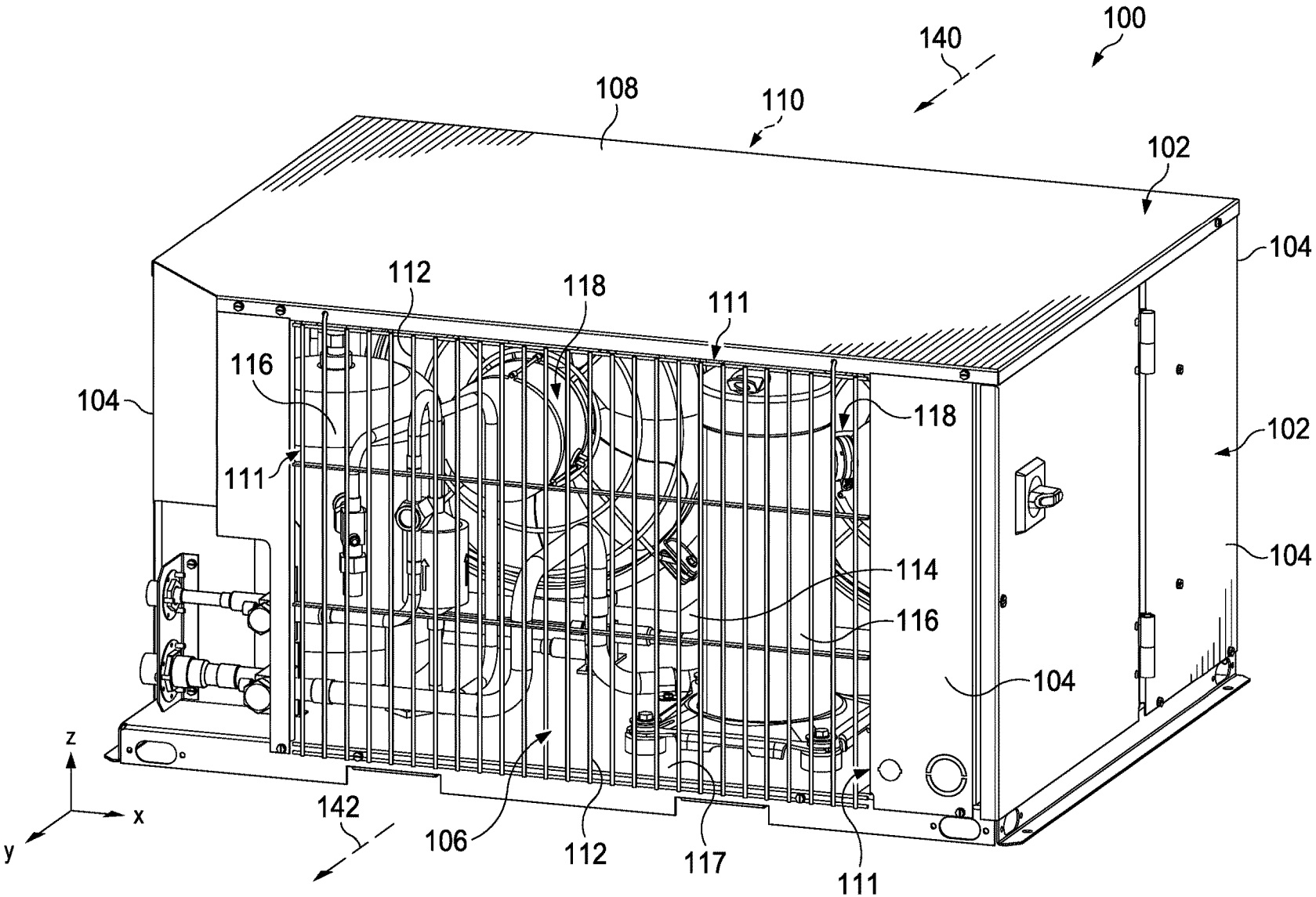
FIG. 1 is a schematic, perspective view of an illustrative embodiment of condenser unit housing for use in a refrigeration system or a heating ventilation and cooling (HVAC) system.

Referring to drawings and initially to FIG. 1, an illustrative embodiment of a condenser unit housing 102 that is used in a refrigeration system 100 is presented. It should be appreciated that the condenser unit housing 102 and the refrigeration system 100 may be a heating ventilation and cooling (HVAC) system.

The condenser unit housing 102 holds one or more condensers 116 and an associated equipment and may take various forms. In one illustrative, non-limiting embodiment, the condenser unit housing 102 is a horizontal discharge unit that discharges air horizontally out of the condenser unit housing 102; for example, in this illustrative embodiment, the air is discharged in the y-direction for the orientation shown. The condenser unit housing 102 includes a plurality of outer walls 104, e.g., four walls in this illustrative embodiment. The outer walls 104 generally have a vertical orientation or z-direction (for orientation shown) that at least partially defines an interior space 106 therein that houses various components associated with the condenser process. The condenser unit housing 102 further includes a top cover 108 that is connected to at least some of the outer walls 104 and which covers the space 106 on a top portion. The top cover 108 and side walls 104 protect the various components housed within the condenser unit housing 102 from, for example, unauthorized access or environmental factors such as rain, snow, or the like.

Figure 4:
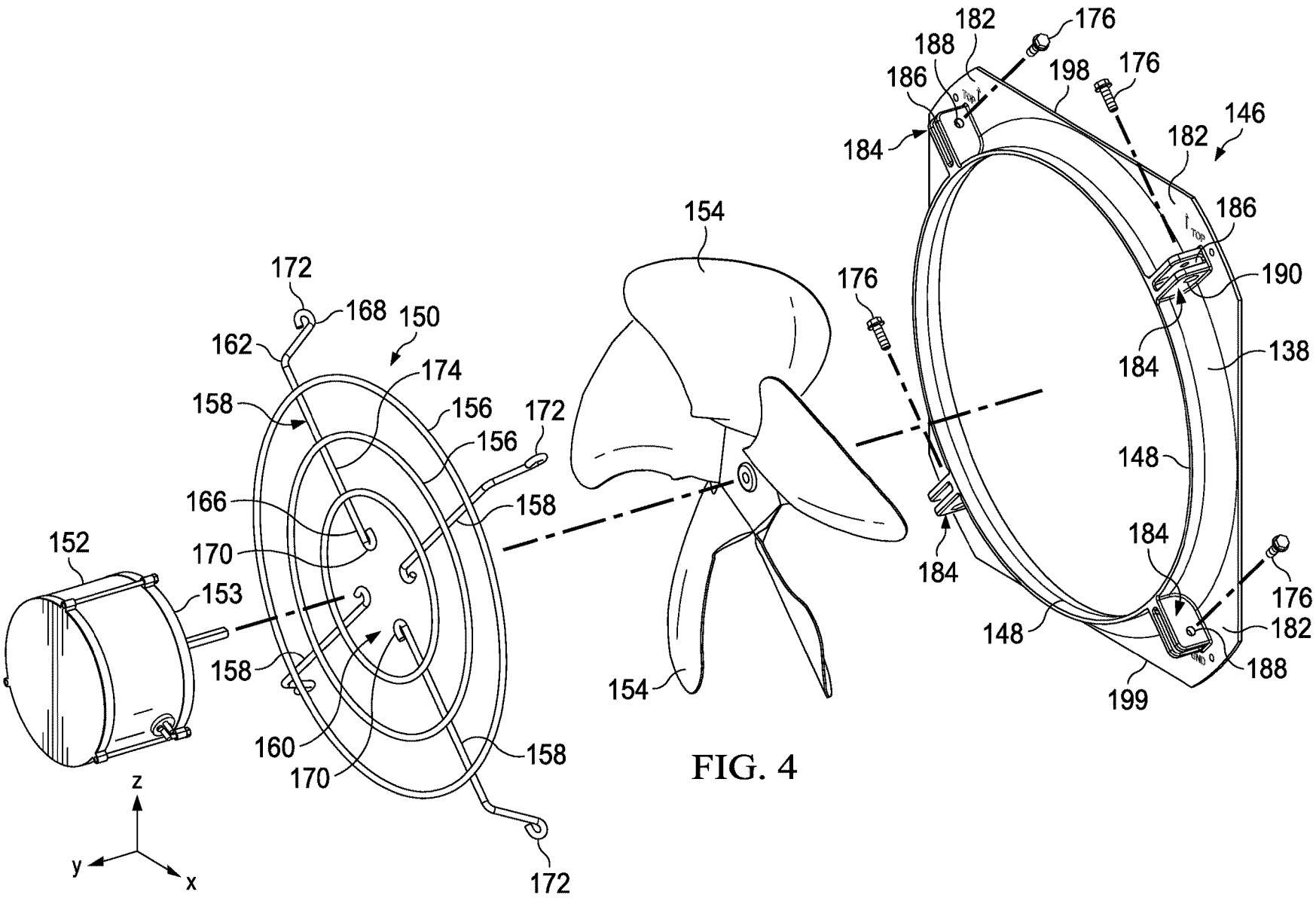
FIG. 4 is a schematic, exploded, perspective view of the fan mounting assembly of FIG. 4.
Figure 8:
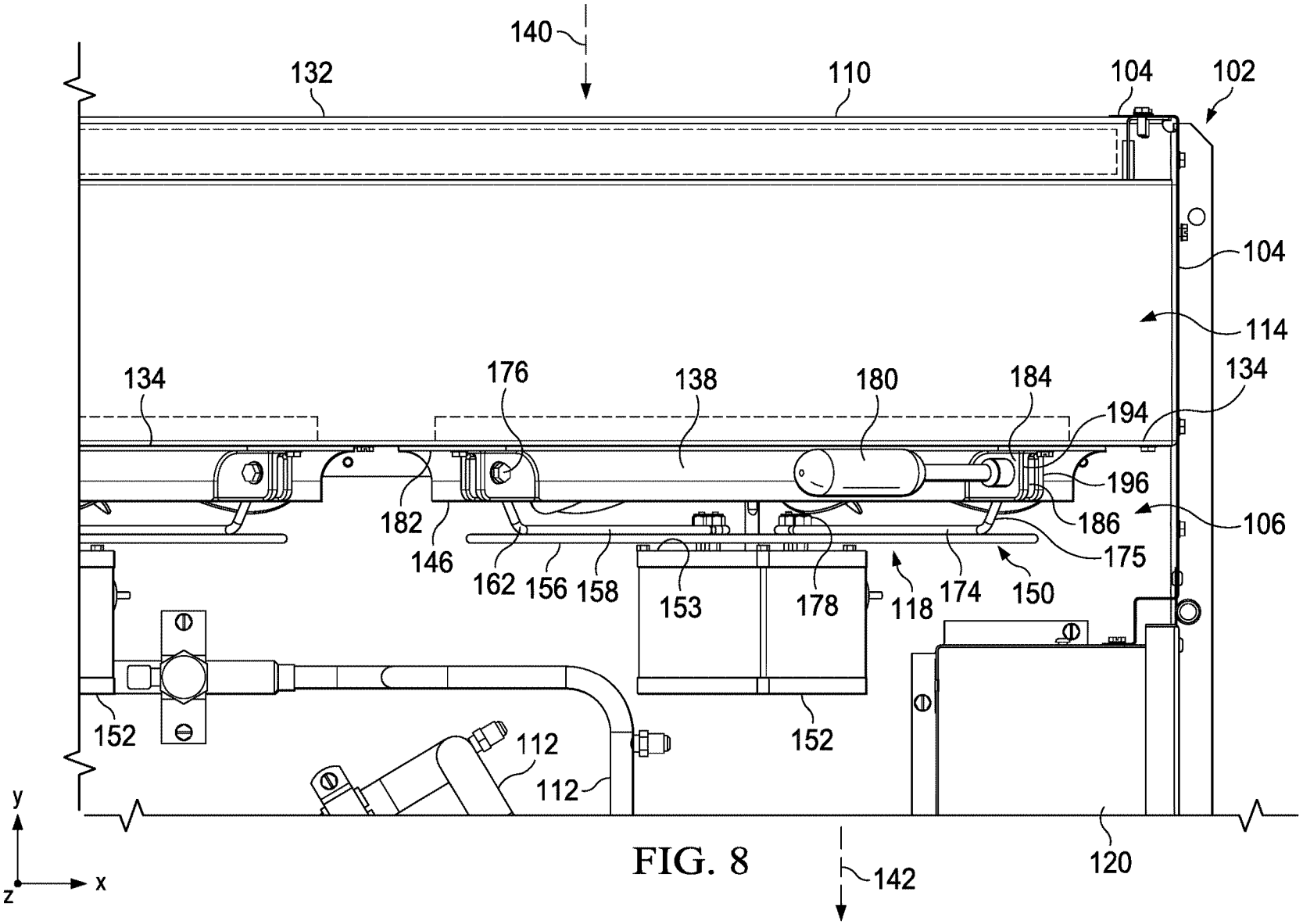
FIG. 8 is a schematic, top, partial view of the condenser unit with a top portion removed, illustrating the fan mounting assembly coupled to the condenser fan panel, according to an embodiment.
Figure 9:
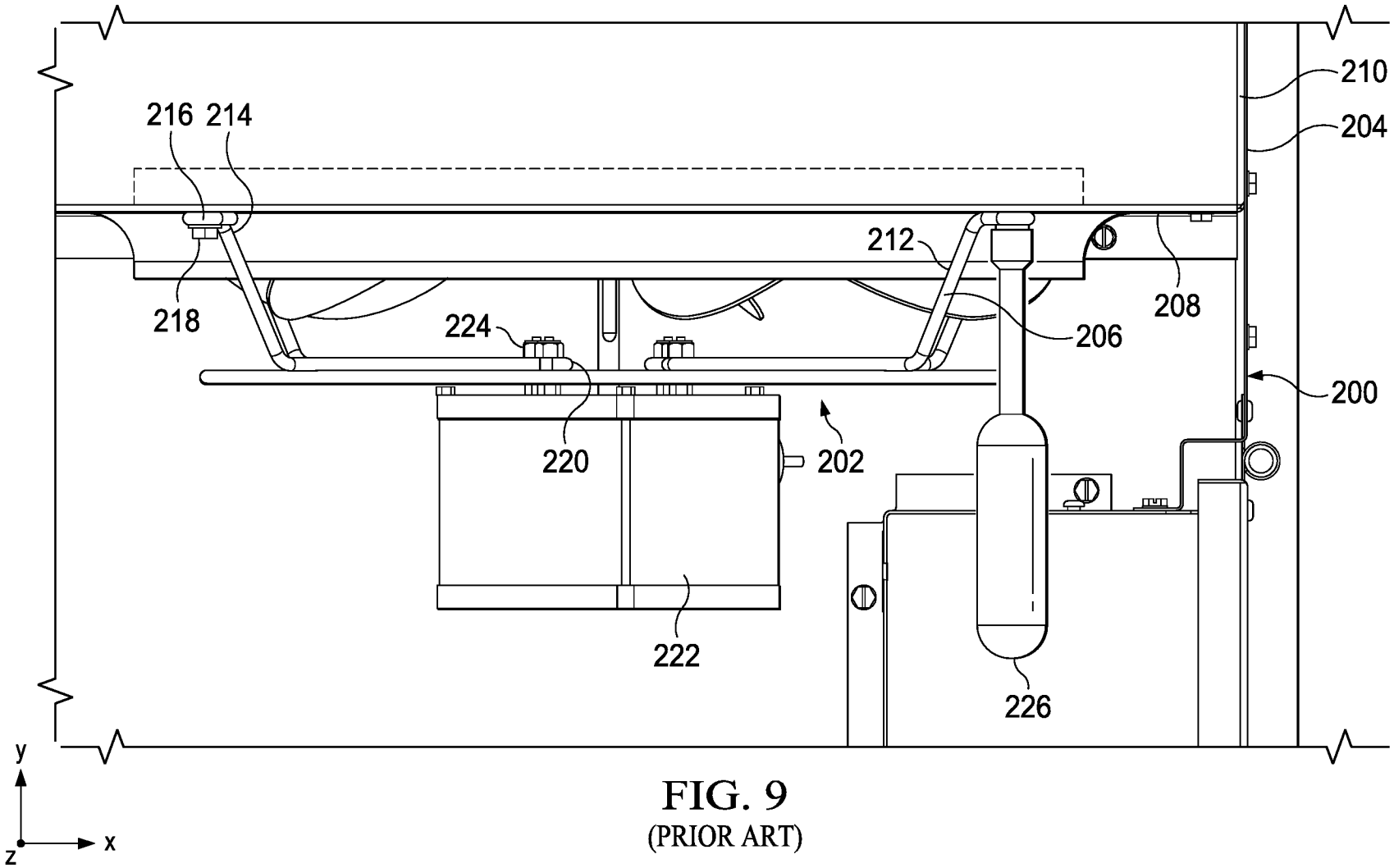
FIG. 9 (PRIOR ART)
FIG. 9 is a schematic, top, partial view of a condenser unit with a top portion removed, illustrating a fan mounting assembly coupled to a condenser fan panel, according to the prior art.

Still referring primarily to FIG. 1, and with reference also to FIGS. 4 and 9, the condenser unit housing 102 includes the one or more condensers 116 (FIG. 1) coupled typically to a floor portion 117. The one or more condensers 116 are positioned in relatively close proximity (e.g., within two to three feet) to one or more fan mounting assemblies 118 within the condenser unit housing 102. FIG. 1 illustrates the condenser unit housing 102 having two fan mounting assemblies 118 mounted or coupled to a condenser fan panel assembly 114 (more clearly shown in FIGS. 4 and 8), with each of the two fan mounting assemblies 118 positioned side-by-side in a horizontal direction, e.g., in this embodiment in the x-direction. In some embodiments, there may be only one fan mounting assembly 118. In other embodiments, there may be more than two fan mounting assemblies 118. In yet some embodiments, the fan mounting assemblies 118 may be positioned side-by-side in a vertical direction, e.g., in the z-direction. The fan mounting assemblies 118 are coupled to the condenser fan panel assembly 114 on a vertical (z-direction) portion using fasteners or techniques. One skilled in the art will understand that the fan mounting assemblies 118 maybe coupled to the condenser fan panel assembly 114 in a number of different arrangements.

The condenser fan panel assembly 114 includes a ventilation opening or inlet 110 (see FIG. 8) to allow air to enter the condenser fan panel assembly 114 and typically discharges on the opposite side. It will be appreciated that the condenser unit housing 102 is configured to include one or more openings that allow air to flow into the ventilation inlet 110, across the condenser coils 144 (FIG. 3), and then exit the condenser unit housing 102 through a ventilation outlet 111. In some embodiments, the condenser fan panel assembly 114 may share a wall with the condenser unit housing 102 such that the ventilation inlet 110 may be formed in both the condenser fan panel assembly 114 and the condenser unit housing 102. In other embodiments, the condenser fan panel assembly 114 and the condenser unit housing 102 may be distinct but have adjoining or adjacent walls, with the condenser fan panel assembly 114 having a ventilation inlet 110 and the condenser unit housing 102 having a separate opening formed therein (not explicitly shown) that corresponds with the ventilation inlet 110 to allow airflow into the condenser fan panel assembly 114.

In operation, air is pulled into the condenser unit housing 102 and the condenser fan panel assembly 114 via the fan mounting assemblies 118, which will be discussed in more detail below. The air enters the ventilation inlet 110 and flows over condenser coils 144 (see FIG. 3) that are positioned in the condenser fan panel assembly 114. The air is then discharged out of the condenser unit housing 102 through the ventilation outlet 111. In some embodiments, air flows into the condenser fan panel assembly 114, via the ventilation inlet 110, along the direction of arrow 140 (FIG. 8), e.g., the y-direction, and may be subsequently discharged, via the ventilation outlet 111, in an essentially horizontal direction relative to the condenser unit housing 102 along the direction of arrow 142, e.g., in the y-direction. A grate 112 (FIG. 1) or other protective cover covers the ventilation outlet 111 and is configured to allow air to flow out of the condenser unit housing 102, while guarding or restricting access to the ventilation outlet 111, e.g., to prevent unauthorized personnel or animals from gaining access to the space or contents within the condenser unit housing 102 or inadvertently encountering a fan blade. In some embodiments, air may flow into the condenser unit housing 102 from other directions, including a vertical direction, such as along the z-direction.

In some embodiments, components inside the condenser unit housing 102, such as the one or more fan mounting assemblies 118, may be accessed by a technician by removing the top cover 108. A technician may also remove the grate 112 to access some of the components inside the condenser unit housing 102. Either the top cover 108, the grate 112 or both may be removed by a technician depending on the component the technician is wanting to access within the condenser unit housing 102. Increasing the technician's accessibility to components within the condenser unit housing 102, e.g., for maintenance or replacement of the components, may be beneficial and is a focus of certain improvements herein. The condenser unit housing 102, with particular focus on the condenser fan panel assembly 114 and the fan mounting assemblies 118, will be described in more detail below with further reference to FIGS. 2 and 4-9. Throughout the figures, like numerals will be used to refer to like elements.

Figure 2:
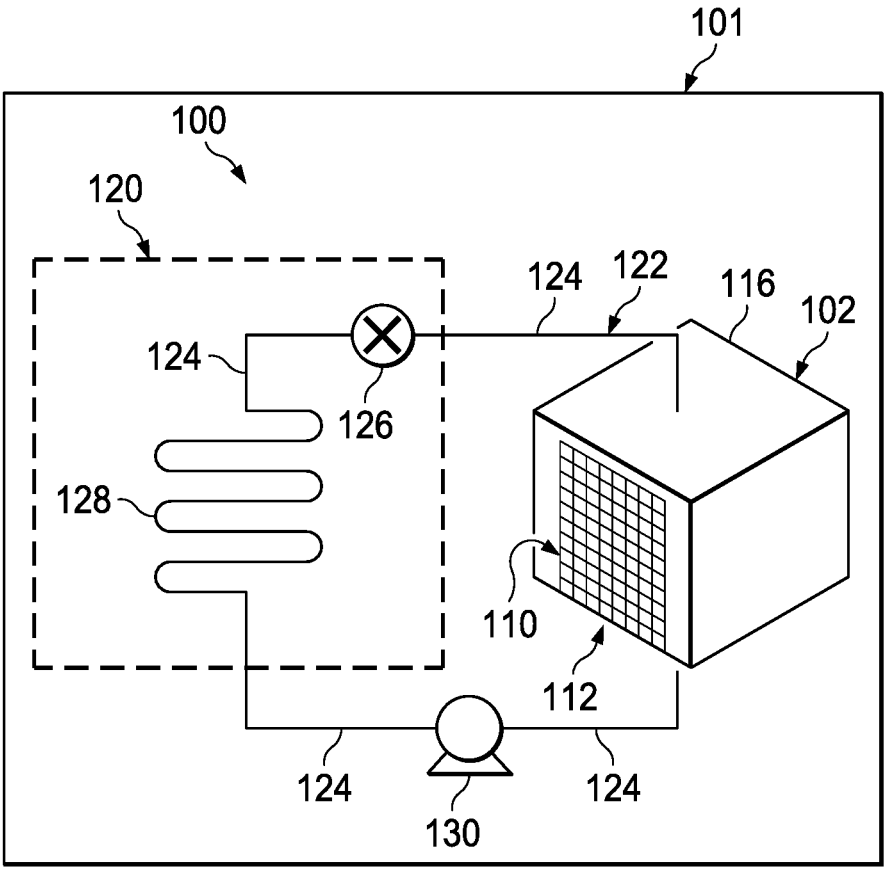
FIG. 2 is a schematic diagram of a heating ventilation and cooling (HVAC) system with a condenser unit housing, according to an illustrative embodiment.

Referring now primarily to FIG. 2, a schematic diagram of a heating ventilation and cooling (HVAC) system 101, including the refrigeration system 100 is presented. The refrigeration system 100 may be used to cool a climate-controlled area or a refrigerated space 120, which may include a refrigerator, cooler, building or the like. The refrigeration system 100 includes a closed refrigeration circuit 122 having a plurality of fluidly coupled conduits 124 connecting various components of the closed refrigeration circuit 122. The closed refrigeration circuit 122 further includes the condenser 116 fluidly coupled to the plurality of conduits 124, an expansion device 126 fluidly coupled to the plurality of conduits 124, an evaporator 128 fluidly coupled to the plurality of conduits 124, and a compressor 130 fluidly coupled to the plurality of conduits 124. The compressor 130 is shown separate from the condenser housing unit 102, but is typically located within the condenser housing unit 102. A refrigerant flows through the closed refrigeration circuit 122 in a circuit as a working fluid. The refrigerant may include conventional refrigerants such as hydrofluorocarbons, carbon dioxide and other suitable refrigerants. It should be appreciated, that multiple refrigeration cycles may use differing refrigerants in the same refrigeration system.

The expansion device 126 may include an expansion valve positioned between and fluidly coupled to both the condenser 116 and the evaporator 128. In one embodiment, the expansion device 126 is located in the refrigerated space 120 or a location to cool air to be delivered to the refrigerated space 120. In another embodiment, the expansion device 126 is located outside of the refrigerated space 120 and is adjacent to or housed next to the condenser 116. Generally, the expansion device 126 reduces the pressure and temperature of the refrigerant outputted from the condenser 116, which is then fed to the evaporator 128. The expansion device 126 may be any conventional design and may have any suitable size, shape, configuration or capacity.

The evaporator 128 may be comprised of one or more evaporators that include one or more evaporator coils and one or more evaporator fans. In FIG. 2, the evaporator 128 is shown as being positioned within the refrigerated space 120. However, again, in some embodiments, the evaporator 128 may be adjacent to the refrigerated space 120 or in a manifold for cooling air to be delivered to the space. In operation, evaporator fans draw air from the refrigerated space 120 over the evaporator coils to provide a heat exchange with the refrigerant flowing through the evaporator 128. The evaporator 128 may be any design and be any suitable size, shape, configuration or capacity.

Still referring primarily to FIG. 2, the compressor 130 may include one or more compressors. The compressor 130 is positioned between and fluidly coupled to both the evaporator 128 and the condenser 116. In FIG. 2, the compressor 130 is not housed with the condenser unit housing 102; however, in some embodiments, the compressor 130 is housed with the condenser unit housing 102. The compressor 130 compresses the refrigerant received from the evaporator 128 before the refrigerant is fed to the condenser 116. The compressor 130 acts on the refrigerant to increase the pressure of the refrigerant before the refrigerant is fed to the condenser 116. The compressor 130 may be any conventional design and may be any suitable size, shape, configuration or capacity.

The condenser 116, which is housed in the condenser unit housing 102, may be a gas cooler and may include one or more condenser coils 144 (FIG. 4) and one or more fan mounting assemblies 118 (see, e.g., FIGS. 1 and 4). In operation, the fan mounting assemblies 118 pull in ambient air or cooling air over the condenser coils 144 to provide a heat exchange with the refrigerant flowing through the condenser 116—to cool the refrigerant. The fan mounting assemblies 118 then discharge air out of the condenser unit housing 102. The condenser 116 may be any design and may have any suitable size, shape, configuration or capacity.

Figure 3:
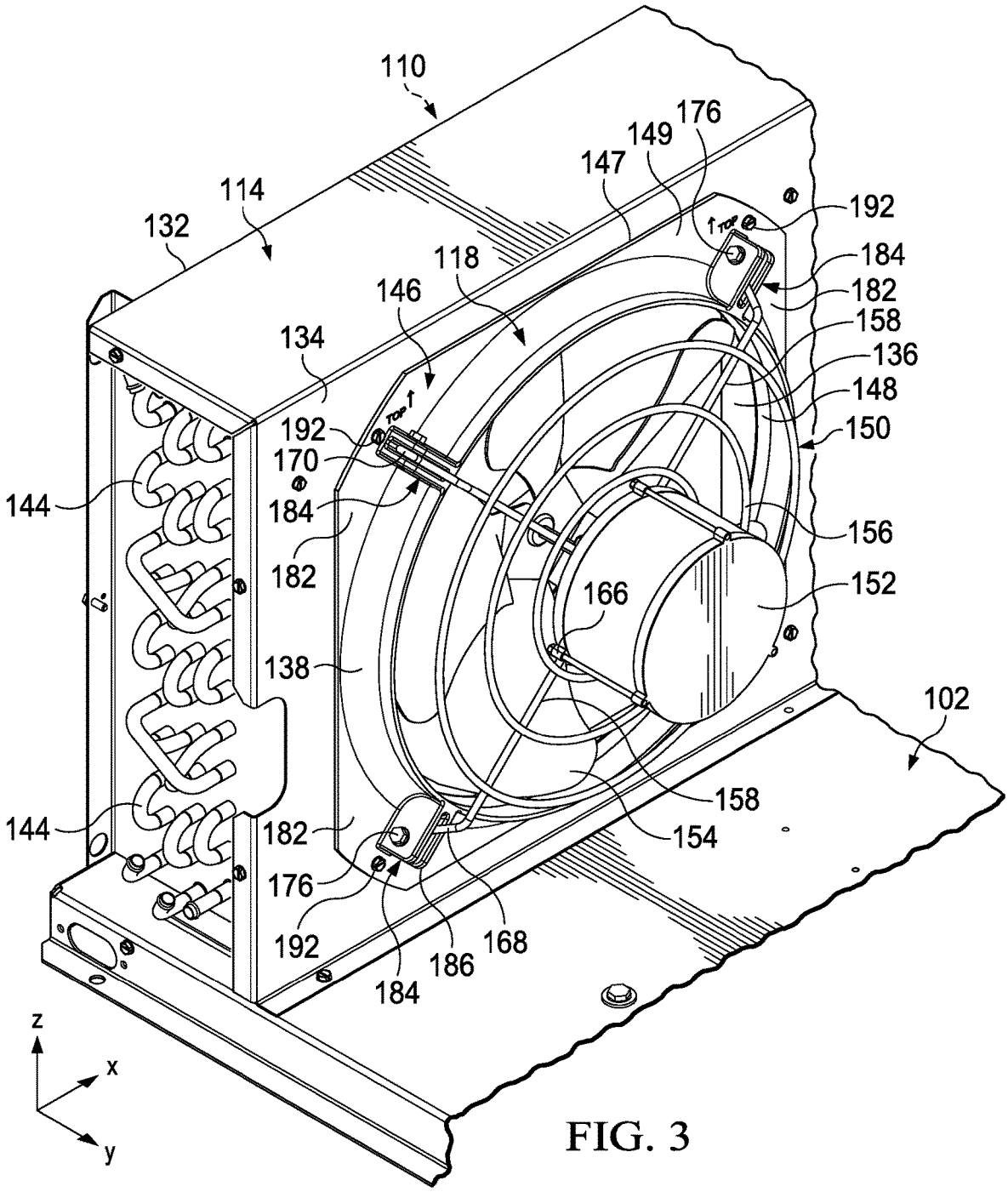
FIG. 3 is a schematic, partial, perspective view of a condenser unit, illustrating a fan mounting assembly coupled to a condenser fan panel, according to an embodiment.

Referring now primarily to FIGS. 3-7, and initially to FIG. 3, an illustrative embodiment of a condenser fan panel assembly 114, with one of the fan mounting assemblies 118 attached thereto, is presented. The fan mounting assembly 118 includes a motor mount and guard 150. The condenser fan panel assembly 114 also includes an outer wall 132 (facing away from fan motor 152) and an opposing, inner wall 134 to which the fan mounting assembly 118 is attached. The condenser fan panel assembly 114 includes a number of condenser coils 144 between the outer and inner walls 132, 134. As previously described above with reference to FIG. 1, air is pulled into the condenser fan panel assembly 114 and flows over the condenser coils 144 to cool the refrigerant in the condenser coils 144. The inner wall 134 includes one or more fan openings 136 formed therein. Air flows out of the condenser fan panel assembly 114 through the fan openings 136 formed in the inner wall 134.

The fan mounting assembly 118 includes a mounting body 146 having a first side 147 and an opposing, second side 149. A fan opening 148 is formed through the mounting body 146 and extends all the way through the mounting body 146 between the first side 147 and the second side 149 to allow air to flow therethrough.

The mounting body 146 includes a lip member or collar 138, plurality of flanged members 182, and a plurality of retaining gusset members 184. In some embodiments, the mounting body 146 is an integral body. In one illustrative embodiment, there are four retaining gusset members 184 spaced at clock positions of about 1:30, 4:30, 7:30, and 10:30. Of course, one skilled in the art will understand that other positions and other numbers of gusset members 184 may be used.

The lip member 138 is formed on or extends from the second side 149 of the mounting body 146 and surrounds the fan opening 148. The plurality of flanged members 182 extend radially outboard of the fan opening 148 and the lip member 138. The plurality of retaining gusset members 184 extends from the second side 149 of the mounting body 146, that is in the y-direction. Each of the plurality of retaining gusset members 184 include a gusset channel 186 that is formed therein. The plurality of retaining gusset members 184 and the gusset channel 186 extends radially outward from the fan opening 148 and the lip member 138. The gusset channel 186 includes a longitudinal axis 187 (FIG. 6) that also extends radially outward from the fan opening 148 and the lip member 138. Each of the plurality of retaining gusset members 184 is configured to receive a fastener 176 that when inserted into a corresponding retaining gusset member 184 would be orientated perpendicular to the longitudinal axis 187 of the gusset channel 186.

Figure 7:
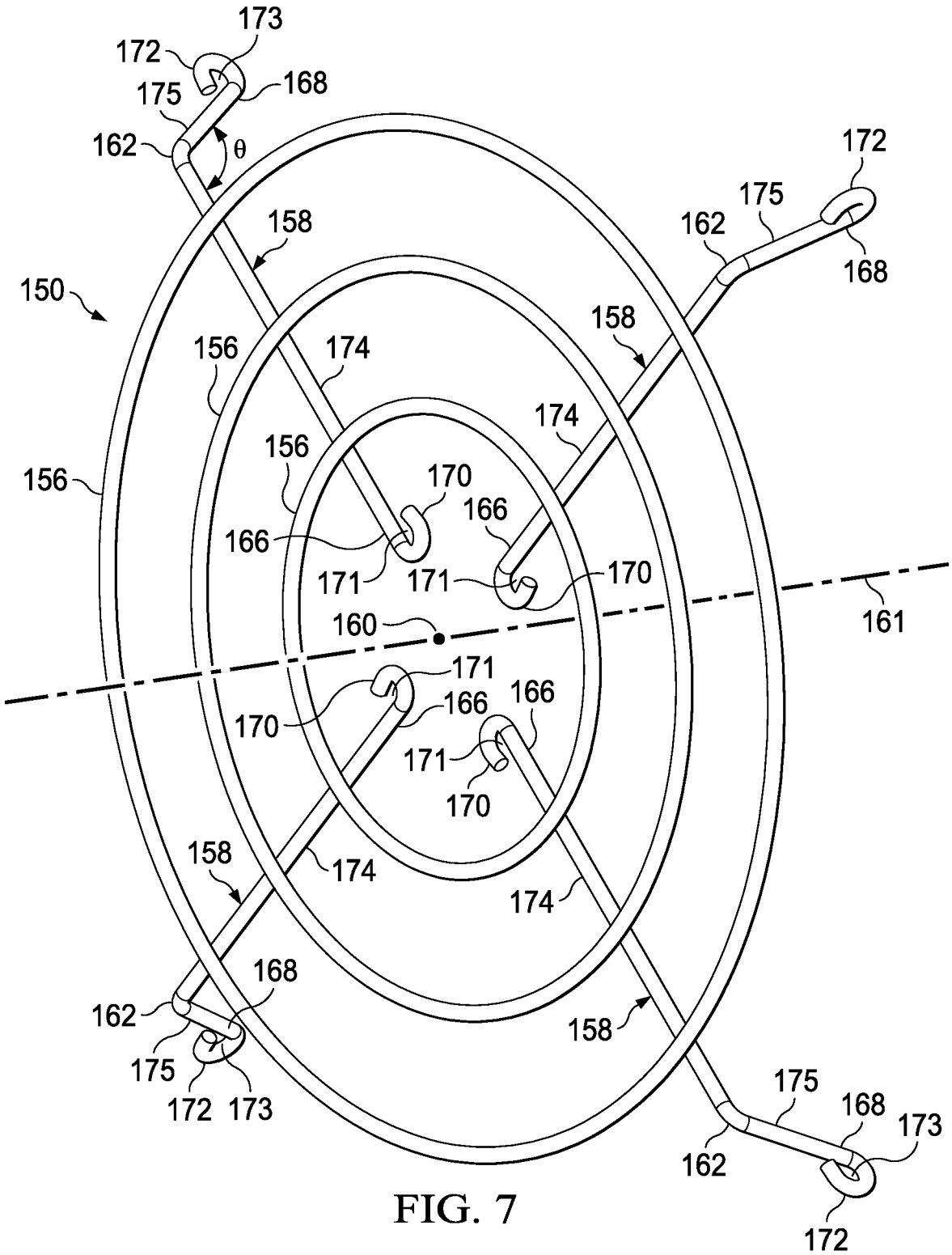
FIG. 7 is a schematic, perspective view of a motor mount and guard that is included in the fan mounting assembly of FIG. 3.

The fan mounting assembly 118 further includes the motor mount and guard 150 that is attached to the mounting body 146. The motor mount and guard 150 may include a grate in the form of a plurality of concentric rings 156 and a plurality of legs 158 that extend radially relative to the concentric rings 156. Each of the plurality of legs 158 has a proximal end 166, or inner most end, and a distal end 168 (FIGS. 4, 7). Each proximal end 166 is formed with a proximal eyelet 170 (FIGS. 4, 7) and the distal end 168 is formed with a distal eyelet 172 (FIGS. 4, 7). The distal eyelet 172 is configured to be positioned within the gusset channel 186. The fastener 176 is configured to secure the distal eyelet 172 to a corresponding retaining gusset member 184. The fastener 176 may be parallel to a plane of the inner wall 134 of the condenser fan panel assembly 114. As will be further described below and more clearly seen in at least FIGS. 4, 7, and 8, the distal eyelet 172 is angled relative to the plane of the inner wall 134.

The fan mounting assemblies 118 further include the fan motor 152 and a plurality of fan blades 154. When assembled, the plurality of fan blades 154 is positioned in or proximate the fan opening 136, which is formed in the inner wall 134 of the condenser fan panel assembly 114. The fan mounting assembly 118 is attached to the condenser fan panel assembly 114 such that the fan opening 148, which is formed in the fan mounting assembly 118, is aligned with or otherwise surrounds the fan opening 136 formed in the condenser fan panel assembly 114. The fan mounting assembly 118 is mounted or otherwise coupled to the inner wall 134 of the condenser fan panel assembly 114. The first side 147 of the mounting body 146 faces and may be directly mounted to the inner wall 134 of the condenser fan panel assembly 114. In some embodiments, the first side 147 of the mounting body 146 is substantially flush with the inner wall 134 of the condenser fan panel assembly 114.

The mounting body 146 may be coupled to the condenser fan panel assembly 114 via fasteners 192. The fasteners extend through the plurality of flanged members 182 and into the condenser fan panel assembly 114 when the fan mounting assembly 118 is mounted to the condenser fan panel assembly 114.

The motor mount and guard 150 is attached to the plurality of retaining gusset members 184. In an installed positioned, the motor mount and guard 150 cages the plurality of fan blades 154 and provides a support for the fan motor 152 to attach thereto. The fan motor 152 is attached to both the plurality of fan blades 154 and the motor mount and guard 150.

Figure 5:
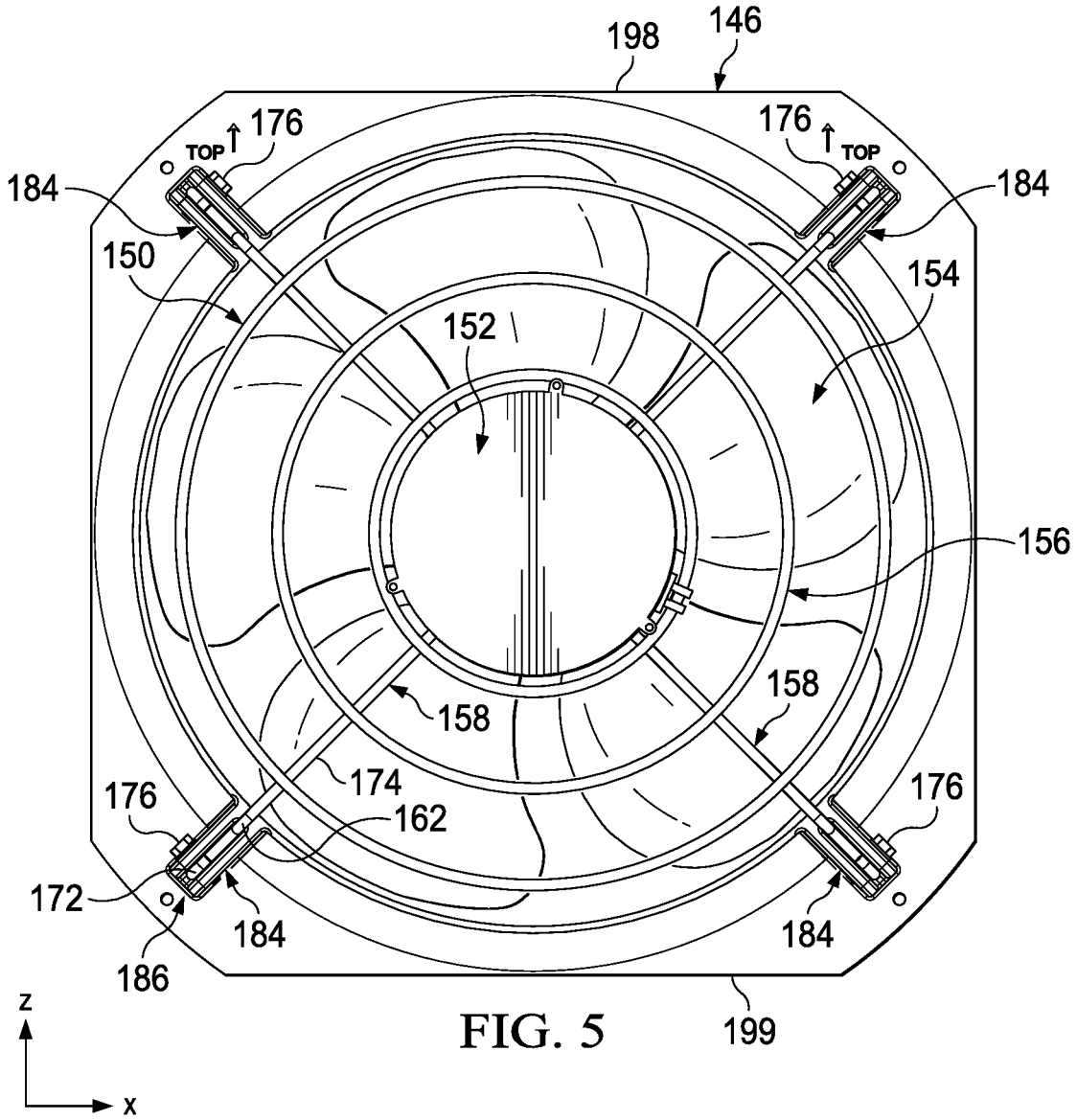
FIG. 5 is a schematic, front view of the fan mounting assembly of FIG. 3.
Figure 6:
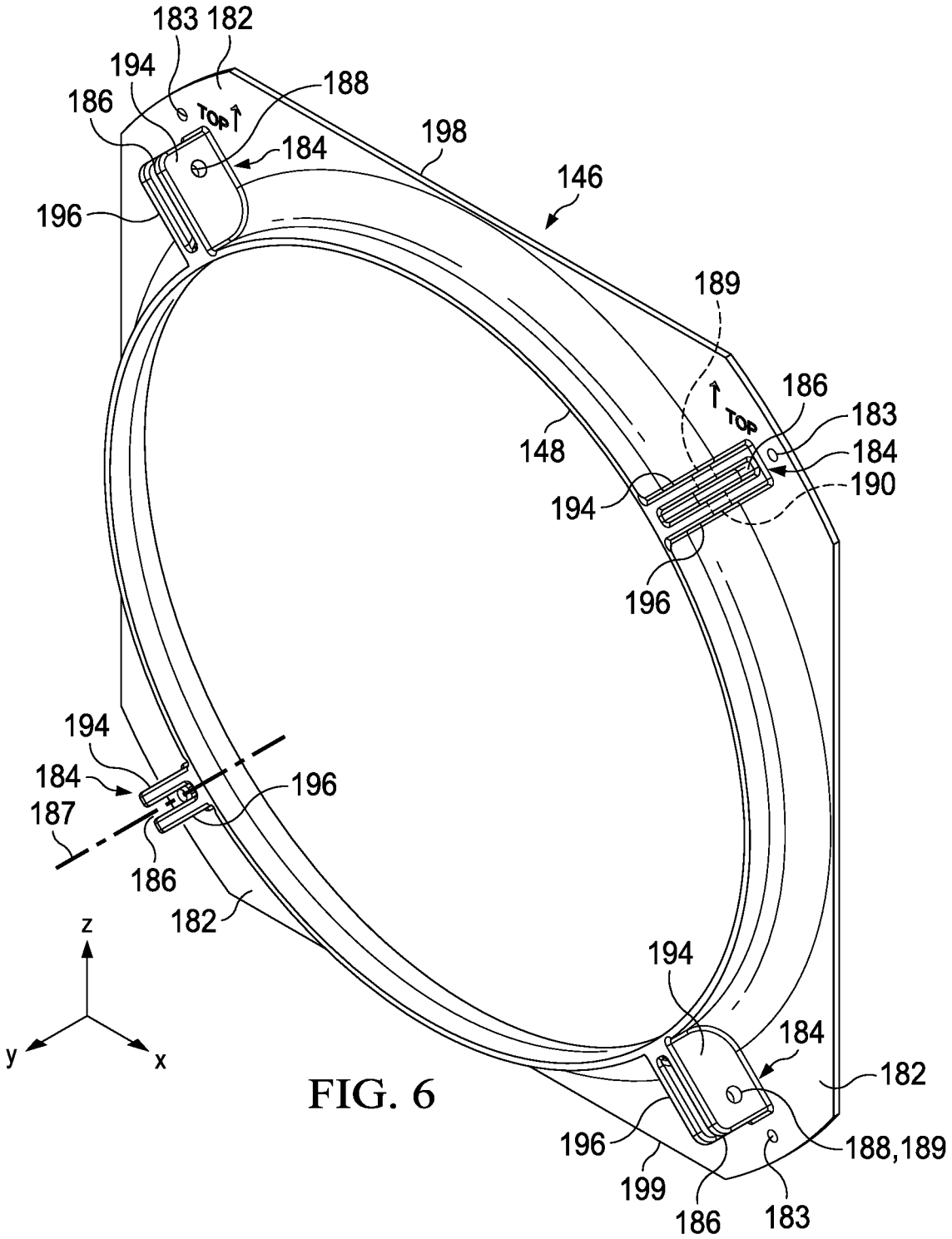
FIG. 6 is a schematic, perspective view of a mounting body that is included in the fan mounting assembly of FIG. 3.

Referring now primarily to FIG. 4, an exploded view of the fan mounting assembly 118 is presented. FIG. 5 illustrates a front view of the fan mounting assembly 118 as assembled. FIG. 6 is a perspective view of the mounting body 146 without the other elements of the fan mounting assembly 118. FIG. 7 is a perspective view of the motor mount and guard 150 without the other elements of the fan mounting assembly 118. It should be appreciated that the cardinal directions illustrated in FIGS. 4-7 relate to the cardinal directions of the assembly illustrated in previous FIGUREs.

As previously referenced in connection with FIG. 1, one or more fan mounting assemblies 118 may be included in a condenser housing unit 102. Each of the plurality of fan mounting assemblies 118 include the mounting body 146 (FIG. 3), the motor mount and guard 150 connected to the mounting body 146, the fan motor 152 connected to one side of the motor mount and guard 150, and the plurality of fan blades 154 connected to the other side of the motor mount and guard 150.

The mounting body 146, in some embodiments, is an integral body and, in some embodiments, may be formed by injection molding or casting. The mounting body 146 has the first side 147 and the opposing, second side 149. In some embodiments, the mounting body 146 may have a square, rectangular, or circular shape as seen from the front view (FIG. 5). The fan opening 148 is formed in the mounting body 146 and extends entirely through the mounting body 146 between the first side 147 and the second side 149. In some embodiments, the first side 147 is substantially flat. The lip member or collar 138 is formed on or as part of and extends away from a planar portion of the second side 149 of the mounting body 146 in, for example, the y-direction. The lip member 138 surrounds the fan opening 148 of the mounting body 146. In some embodiments, the lip member 138 may act is a venturi to direct air flow according to principles of the Venturi effect. In that case, the shape of the lip member 138 is function as venturi.

The mounting body 146 further includes the plurality of flanged members 182 or portions. In some embodiments, the plurality of flanged members 182 includes the portions of the mounting body 146 that extend radially outboard of the fan opening 148 or ourtboard the lip member 138 and may be simply referred to as a flange or flange member. The plurality of flanged members 182 includes a plurality of fastener openings 183 formed therein. The plurality of fastener openings 183 are configured to receive the fasteners 192 (FIG. 3) to secure the mounting body 146 to the condenser fan panel assembly 114. The fasteners 192 typically extend perpendicular to a planar surface of the inner wall 134 of the condenser fan panel assembly 114.

Referring now primarily to FIG. 6, each of the plurality of retaining gusset members 184 includes the gusset channel 186 formed therein. The plurality of retaining gusset members 184 extends radially outward from the fan opening 148 and the lip member 138. In some embodiments, the plurality of retaining gusset members 184 partially extend into the lip member 138 such that the lip member 138 at least partially defines a portion of the plurality of retaining gusset members 184. Likewise, the lip member 138 may at least partially define a portion of the gusset channel 186, e.g., a backwall (radially most inboard) of the gusset channel 186.

The gusset channel 186 is formed such that the gusset channel 186 also extends radially outward from the fan opening 148 with respect to its alignment and then has walls that extend up from the corresponding flange member. The gusset channel 186 may include the longitudinal axis 187 that extends radially outward from the mounting body 146. In some embodiments, each of the plurality of retaining gusset members 184 includes a first side wall 194, or first gusset side wall, and an opposing, second side wall 196, or second gusset side wall. The first side wall 194 and the second side wall 196 at least partially define the gusset channel 186. In some embodiments, the lip member 138 also at least partially defines the gusset channel 186 by forming a back wall.

The plurality of retaining gusset members 184 includes at least one fastener opening 188 or aperture formed therein that is perpendicular to the longitudinal axis 187 of the gusset channel 186. The at least one fastener opening 188 is configured to receive the fastener 176 (FIG. 3) such that when the fastener 176 is inserted into the plurality of retaining gusset members 184 and through the gusset channel 186, the fastener 176 is perpendicular to the corresponding longitudinal axis 187 of the retaining gusset member 184. The the fastener 176 is also parallel to the plane of the inner wall 134 of the condenser fan panel assembly 114.

In some embodiments, the at least one fastener opening 188 is a first fastener opening 189 that is formed in the first sidewall 194 and a second fastener opening 190 may be formed in the second side wall 196. In some embodiments, the first opening 188 and the second opening 190 are configured such that during assembly, the fastener 176 may only be inserted into either the first opening 188 or the second opening 190 so that a head of the fastener 176 is positioned on the sidewall of the retaining gusset members 184 that faces upward for the installed position (sidewall highest respect to gravity field). Preventing the head of the fastener 176 from being positioned in a downward direction may help maintain accessibility to the fastener 176 for removal. In some embodiments, the first opening 189 may be larger than the second opening 190. In yet some embodiments, the second opening 190 may include a nut (not shown) that is positioned inside the second opening 190. The nut may be press fit into the second opening 190 during the molding process of the fan mounting assembly 118. The nut may also be positioned in the second opening 190 by a clearance hold or an engagement hold.

Still referring primarily to FIGS. 3-7, the motor mount and guard 150, an element of the fan mounting assemblies 118, is attached to the mounting body 146 and, in particular, the retaining gusset members 184. The motor mount and guard 150 may include the plurality of concentric rings 156 and the plurality of legs 158 extending radially from a center portion 160, which is along a central axis 161 (FIG. 7), of the motor mount and guard 150. The plurality of concentric rings 156 are substantially parallel to a plane of the inner wall 134 of the condenser fan panel assembly 114 when assembled. The plurality of legs 158 are connected to the plurality of concentric rings 156 to form a cage member.

Referring primarily to FIG. 7, each of the plurality of legs 158 has the proximal end 166 (radially most inboard) and the distal end 168 (radially most outboard). A first straight portion 174 extends between the proximal end 166 and a bend 162 is formed in the legs 158. The first straight portion 174 is connected to the plurality of concentric rings 156 and is substantially parallel to the plane of the inner wall 134 of the condenser fan panel assembly 114 when assembled. The bend 162 directs the legs 158 away from the plurality of concentric rings 156 and toward a plane of the inner wall 134 in the assembled position. A second straight portion 175 extends radially outboard from the bend 162 and away from the most outboard concentric ring and toward the inner wall 134. In some embodiments, the second straight portion 175 is angled, θ, between approximately 90° and 180° from the first straight portion 174. The second straight portion 175 includes the distal end 168.

The proximal end 166 of each leg 158 is formed with the proximal eyelet 170, and the distal end 168 is formed with the distal eyelet 172. The proximal eyelet 170 forms a proximal eyelet opening 171 and the distal eyelet 172 forms a distal eyelet opening 173. The proximal eyelets 170 and the distal eyelets 172 are angled relative to each other—typically by 90 degrees. As such, the proximal eyelet opening 171 and the distal eyelet opening 173 do not open and the same direction.

When assembled, each of the proximal eyelets 170 is generally positioned flush against a back face 153 (FIGS. 4, 8) of the fan motor 152 such that a fastener 178 (FIG. 8) is inserted through the proximal eyelet opening 171 and into the fan motor 152. The fastener 178 is inserted perpendicular to a back face of the fan motor 152, e.g., the portion of the fan motor 150 that faces the inner wall 134 of the condenser fan panel assembly 114.

When assembled, each of the distal eyelets 172 is positioned into a respective gusset channel 186 such that the distal eyelet opening 173 aligns with the first opening 188 formed in the first wall 194 of the respective plurality of retaining gusset members 184. The fastener 176 is inserted through at least the first opening 188 and the distal eyelet opening 173 to secure the motor mount and guard 152 to the corresponding member of the plurality of retaining gusset members 184. The fastener 176 is inserted substantially parallel to a plane of the inner wall 134 of the condenser fan panel assembly 114. Hence, the proximal end 170 and the distal end 172 are angled relative to each other.

The motor mount and guard 150 is attached to the retaining gusset members 184, which is outward of the lip member 138. Thus, the distal end 168 of each of the plurality of legs 158, including each of the distal eyelets 172, is positioned outward of the lip member 138.

Referring now primarily to FIG. 8, a schematic, top, partial view of the condenser unit housing 102 illustrating the fan mounting assemblies 118 coupled to the condenser fan panel assembly 114, is presented. The condenser unit housing 102 is shown without the top cover 108 (see FIG. 1) to better illustrate components within the condenser unit housing 102.

The air inlet 110 is a schematic representation of an opening, which allows air to flow into the condenser fan panel assembly 114, and it will be appreciated by one of skill in the art that the air inlet 110 may have a number of different configurations. After the air has passed through the condenser fan panel assembly 114 to cool the condenser coils 144 (see FIG. 3), the air is then discharged along the direction of arrow 142, which is generally in a horizontal direction from the condenser unit housing 102, e.g., the y-direction as depicted.

The condenser unit housing 102 further includes a number of conduits 112 that interconnect various elements involved in the condenser process, an electrical box 120, and various other components that may be involved in the condenser process. The positioning of various components within the condenser unit housing 102, including the trend and desire for smaller condenser unit housings, makes accessing, maintaining, or otherwise replacing components within the condenser unit housing 102 increasingly challenging for technicians. The configuration of the motor mount and guard 150 may help alleviate aspects of the challenge.

In operation, technicians may remove at least the top cover from the condenser unit housing 102 to perform maintenance or replacement of components of the fan mounting assembly 118. The technician uses a tool 180, e.g., socket driver wrench or nut driver or a screw driver, to remove the fasteners 176 that attach the motor mount and guard 150 to the gusset member 184 of the mounting body 146. As previously mentioned, the fasteners 176 are inserted through the retaining gusset members 184, which orients fasteners 176 parallel to the plane of the inner wall 134 of the condenser fan panel assembly 114. Thus, the tool 180 may be inserted parallel to the plane of the inner wall 134 so that the tool 180 is aligned with the fasteners 176. The orientation of the fasteners 176 and the corresponding tool 180 may make it easier for the technician to position or otherwise align the tool 180 with the fasteners 176 to remove the fasteners 176 due to spacing constraints; that is, this arrangement avoids interference from other components within the condenser unit housing 102. In other words, some elements, for example the electrical box 120, may no longer interfere with alignment of the tool 180 with the fasteners 176 as the technicians seeks to remove the fasteners 176. The fastener 176 orientation that is used to secure the motor mount and guard 152 to the fan mounting assembly 118 differs in important ways from the fastener 276 orientation illustrated in the prior art of FIG. 9 described below.

Referring now to FIG. 9, a top, partial view of a condenser unit housing 200 is presented. The condenser unit housing 200 includes a known fan mounting assembly 202 coupled to a condenser fan panel assembly 204. A fan cage 206 is attached to an inner wall 208 of a fan panel 210. The fan cage 206 includes legs 212 having feet 214 formed with flat, flush eyelets 216. A fastener 218 is used to couple the legs 212 to the inner wall 208. The legs 212 have an motor attachment end 220 that is flush with a motor 222 and that is attached using a fastener 224. Note that because of the fastener 218 goes through the flat, flush eyelets 216 with the fastener head parallel to a plane of the inner wall 208, a tool 226 has to be applied straight on, i.e., perpendicular to the plane of the inner wall 208. As such, the tool 226 is very close to other components and poses a difficult situation for the technician. This issue is largely avoided using the illustrative embodiments of FIGS. 1-8.

The illustrative embodiments of FIGS. 1-8 allow the technician to apply a tool 180 (FIG. 8) in a plane that is substantially parallel to the plane of the inner wall 134. This makes it much easier to service. Other advantages exist.

In the detailed description herein of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A refrigeration system for cooling a climate-controlled area, the system comprising:

a closed refrigeration circuit comprising:

a plurality of fluidly coupled conduits, an expansion valve fluidly coupled to the plurality of conduits, an evaporator fluidly coupled to the plurality of conduits downstream of the expansion valve, a compressor fluidly coupled to the plurality of conduits downstream of the evaporator, and a condenser fluidly coupled to the plurality of conduits downstream of the compressor, the condenser comprising a condenser fan panel assembly with a ventilation opening and a fan mounting assembly coupled to the condenser fan panel assembly; and wherein the fan mounting assembly comprises:

a mounting body having a first side and a second side with a fan opening formed therethrough, the mounting body comprising:

a lip member formed on the second side of the mounting body and positioned around the fan opening, a plurality of flange members extending outboard of the lip member, and a plurality of retaining gussets each comprising a gusset channel and formed with at least one fastener opening perpendicular to the gusset channel, wherein the gusset channel extends radially outward from the fan opening, wherein each of the plurality of retaining gussets comprises a first side wall and a spaced second side wall that at least partially form the gusset channel between the first side wall and the spaced second side wall;

a motor mount and guard comprising a plurality of concentric rings and a plurality of legs extending radially at least partially from a center portion, wherein each leg of the plurality of legs has a proximal end and a distal end, and the distal end is formed with a distal eyelet for receiving a fastener and wherein the distal eyelet is configured to align with the at least one fastener opening of a corresponding gusset channel of the plurality of retaining gussets; a fan motor coupled to the motor mount and guard proximate the center portion; and a plurality of fan blades coupled to the fan motor.

2. The system of claim 1, wherein the mounting body is formed as an integral unit.

3. The system of claim 1, wherein the first side of the mounting body is positioned against the condenser fan panel assembly.

4. The system of claim 1, wherein the lip member acts as a venturi.

5. The system of claim 1, further comprising a proximal eyelet formed on the proximal ends of each of the plurality of the legs, wherein each proximal eyelet is perpendicular to the distal eyelet on the same leg of the plurality of legs.

6. The system of claim 1, wherein the at least one fastener opening is formed in one of the first side wall or the second side wall and another fastener opening is formed in the other side wall, the fastener openings being different sizes.

7. The system of claim 1, further comprising a second fan mounting assembly.

8. A fan mounting assembly for use in a refrigeration system, the fan mounting assembly comprising:

a mounting body having a first side and a second side with a fan opening formed therein, the mounting body comprising:

a collar formed on the second side of the mounting body, the collar positioned around the fan opening, a plurality of flange members extending outboard of the collar, and a plurality of retaining gussets extending from the second side of the mounting body radially outward from the fan opening and having walls extending perpendicular to a plane of the second side of the mounting body, each of the plurality of retaining gussets having a fastener opening extending therethrough, wherein each of the plurality of retaining gussets is formed with a first sidewall and a second sidewall that are spaced to form a gusset channel therebetween;

a motor having a longitudinal shaft and a surface perpendicular to the shaft; and a motor mount and guard member comprising:

a plurality of rings and a plurality of legs, wherein the plurality of legs extend radially outward at least partially from a center portion, and wherein each leg of the plurality of legs has a proximal end with a proximal eyelet formed thereon and a distal end with a distal eyelet formed thereon and wherein the distal eyelet is configured to align with the fastener opening of a corresponding retaining gusset and wherein the proximal eyelets are configured to attach in a flush manner on the surface of the motor.

9. The assembly of claim 8, further comprising:

a plurality of fan blades coupled to the longitudinal shaft of the fan motor.

10. The assembly of claim 8, wherein the mounting body is an integral body formed by injection molding.

11. The assembly of claim 8, wherein the collar is a venturi opening.

12. The assembly of claim 8, wherein the proximal eyelets face a different direction than the distal eyelets by approximately 90 degrees.

13. The assembly of claim 8, wherein the plurality of retaining gussets include a first side wall and a second side wall, the first side wall and second side wall at least partially define a gusset channel configured to receive a respective distal eyelet of the plurality of legs, wherein the fastener opening is perpendicular to the gusset channel and the fastener opening is formed in one of the first side wall or the second side wall.

14. The assembly of claim 13, wherein the fastener opening is a first fastener opening formed in the first side wall, and the assembly further comprising a second fastener opening formed in the second side wall, wherein the first fastener opening is a different size than the second fastener opening.

15. A fan mounting assembly for use in a refrigeration system, the fan mounting assembly comprising:

a mounting body having a first side and a second side with a fan opening formed therein; a collar extending formed on the second side of the mounting body around the fan opening;

a plurality of retaining gussets each comprising a gusset channel and formed with at least one fastener opening perpendicular to the gusset channel, wherein the gusset channel extends radially outward from the fan opening; and a motor mount and guard for holding a motor and fan blades coupled to the motor proximate the mounting body, wherein the motor has a face in the direction of the fan blades, and wherein the motor mount and guard comprise a plurality of rings and a plurality of legs, wherein the plurality of legs extend radially outward from a center portion, wherein each leg has a proximal end with a proximal eyelet and a distal end with a distal eyelet, wherein the distal eyelet is configured to align with the fastener opening of a corresponding gusset channel while in the gusset channel, and the proximal eyelet is configured to couple to the face of the motor in a flush manner.

16. The assembly of claim 15, further comprising:

a fan motor coupled to the proximal eyelets; and a plurality of fan blades coupled to the fan motor.

17. The assembly of claim 15, wherein the proximal eyelets face a direction perpendicular to the distal eyelets.

18. The assembly of claim 15, wherein the mounting body, the collar and the plurality of retaining gussets are an integral body.

19. The assembly of claim 15, wherein the plurality of retaining gussets include a first side wall and a second side wall, the first and second side walls at least partially defining the gusset channel.

20. The assembly of claim 19, wherein the at least one fastener opening is formed in one of the first side wall or the second side wall and another fastener opening is formed in the other side wall, the fastener openings being different sizes.

* * * * *